US005644100A

United States Patent [19]

Puckett et al.

[11] Patent Number: 5,644,100

[45] Date of Patent: Jul. 1, 1997

[54] SABOT FOR HIGH-DISPERSION SHOT SHELL

[75] Inventors: Lawrence J. Puckett, Baltimore; Robert P. Kaste, North East, both of Md.

[73] Assignee: The United States of America as represented by the Secretary of the Army, Washington, D.C.

[21] Appl. No.: 699,365

[22] Filed: Aug. 19, 1996

[51] Int. Cl.[6] ..... F42B 7/00; F42B 14/06

[52] U.S. Cl. ..... 102/457; 102/449; 102/522; 102/532

[58] Field of Search ..... 102/438, 439, 102/448–461, 520–523, 532, 506

[56] References Cited

U.S. PATENT DOCUMENTS

| | | | |
|---|---|---|---|
| 579,429 | 3/1897 | Elliott . | |
| 820,459 | 5/1906 | White . | |
| 875,762 | 1/1908 | Winans et al. . | |
| 1,941,336 | 12/1933 | Barbieri . | |
| 2,382,152 | 8/1945 | Jakobsson . | |
| 2,788,744 | 4/1957 | Donner | 102/522 |
| 3,261,282 | 7/1966 | Hendricks . | |
| 3,469,527 | 9/1969 | Pace . | |
| 3,568,603 | 3/1971 | Vartanian | 102/522 |
| 3,623,431 | 11/1971 | Hendricks | 102/450 |
| 3,724,378 | 4/1973 | Knight et al. | 102/456 |
| 3,796,157 | 3/1974 | Anderson | 102/451 |
| 4,006,688 | 2/1977 | Craft et al. . | |
| 4,167,904 | 9/1979 | Ferri . | |
| 4,506,605 | 3/1985 | Maki . | |
| 4,742,774 | 5/1988 | Flatau . | |
| 4,800,816 | 1/1989 | Meyer . | |
| 4,882,996 | 11/1989 | Bock et al. . | |
| 5,182,419 | 1/1993 | Burnette | 102/523 |
| 5,189,251 | 2/1993 | Puckett . | |
| 5,191,168 | 3/1993 | Puckett . | |
| 5,192,830 | 3/1993 | Puckett . | |

FOREIGN PATENT DOCUMENTS

| | | |
|---|---|---|
| 1262557 | 4/1961 | France . |
| 92430 | 11/1968 | France . |

*Primary Examiner*—Harold J. Tudor

*Attorney, Agent, or Firm*—Freda L. Krosnick; William E. Eshelman

[57] ABSTRACT

A shotgun shell includes a sabot with a tubular portion extending from a base, a chamber disposed within the tubular portion in communication with an opening in the base, a load of shot disposed within the tubular portion around the chamber, and a valve disposed between the chamber and the opening to control the flow of propellant gases into and out of the chamber. The valve can be a choke with a flow constricting orifice that delays pressurization and depressurization of the chamber. Alternatively, or in addition to a choke valve, a movable valve member can be disposed between the chamber and the opening to seal with a valve seat in order to capture high pressure propellant gases which, upon emergence of the sabot from the gun barrel, will assist in creating a highly dispersed shot pattern at close range. Also disclosed are a number of ways in which the sabot can be modified to control the stiffness of the tubular portion in order to change the shape of the shot pattern to suit specific applications.

13 Claims, 5 Drawing Sheets

SABOT FOR HIGH-DISPERSION SHOT SHELL

GOVERNMENTAL INTEREST

The invention described herein may be manufactured, used and licensed by or for the U.S. Government for governmental purposes without payment to us of any royalties thereon.

BACKGROUND OF THE INVENTION

1. Field of the Invention

The present invention relates to ammunition for shotguns and, more particularly, to a sabot for a shotgun shell capable of enhancing shot dispersion.

2. Discussion of the Prior Art

Conventional shotgun shells are designed to produce relatively large and highly dispersed shot patterns at ranges of engagement typical of sporting applications. Such engagements vary from a short range of approximately 20 meters, typical of upland game shooting, to extreme ranges of 40 to 50 meters, typical of water fowling.

Law enforcement agencies have endeavored to exploit the advantages of large shot patterns available from such weapons to improve the effectiveness of law enforcement personnel engaged in close-range anti-personnel actions. Current technology, however, has not produced a shot shell and weapon capable of providing a high dispersion of shot at the short ranges required. Shooting engagement ranges for such operations are usually on the order of 5 to 15 meters, where conventional shot dispersion pattern diameters range from approximately 5 to 20 centimeters. These small diameter patterns do not materially enhance the probability of hitting the personnel target. In fact, single projectile, burst fire and semi-automatic weapons are becoming more popular due primarily to the ability of such weapons to produce a large dispersion pattern of shots.

A typical prior art shotgun shell 20 is illustrated in FIG. 1 and includes a shell casing 22 with a propellant charge 24 disposed therein adjacent a primer 26 at a rear end of the shell and a sabot 28 filled with shot pellets 30 disposed at an opposite, forward end of the shell. Sabot 28 includes a circular base 32 and a hollow cylindrical portion 34 extending from a peripheral edge of the base toward the forward end of the shell. Shot pattern or, in other words, the shape and size of the area occupied by flying shot pellets, is dictated primarily by the construction of the sabot, which is normally designed to produce relatively high dispersion for medium and long range engagements only. The sabot is often formed with a collapsible buffer 36 disposed between the base of the sabot and the propellant charge to assist in forming a uniform, and preferably spherical, shot pattern by absorbing the shock associated with combustion of the propellant charge.

When a conventional shotgun shell is loaded into a gun and fired, the sabot 28 is propelled forward with the shot pellets 30, as shown in FIG. 2, by expansion of the propellant gases 37. Since the sabot 28 and pellets 30 are confined within a gun barrel 38, they are constrained from expanding radially and are moved in an axial direction only. When the sabot 28 emerges from the gun barrel, however, the radial constraint of the barrel is released and the flight of the shot pellets is then influenced primarily by aerodynamic drag and interactions between the shot pellets and the sabot as shown in FIG. 3. In general, the design of the sabot is such that the dispersion of the shot pellets is delayed; and, consequently, the resulting shot pattern is too small to materially enhance the probability of hitting a personnel target at close range.

U.S. Pat. Nos. 5,189,251, 5,191,168 and 5,192,830 to Puckett, which are incorporated herein by reference, disclose sabots for producing high-dispersion shotgun shells, the sabots including recessed portions extending from the base of the sabot into the shot pellets. When a shell carrying such a sabot is fired from a gun, propellant gases are communicated with the recessed portion of the sabot and will tend to expand radially outward when the sabot exits the gun barrel at the muzzle, thereby imparting a radial velocity component to the pellets and accelerating the dispersion of the shot pellets to form relatively large shot patterns at close-range. These patents also disclose sealing gas producing energetic materials, such as gun powder, within the recessed portion of the sabot using a combustible plug. A disadvantage of the former concept is that the internal pressure of the gases within the recessed portion is limited to the pressure of the propellant gases at the gun muzzle, which is typically too low for optimal expansion. The latter concept provides higher internal gas pressure but requires precision timing of the combustion of the plug tailored to the length of the gun barrel.

SUMMARY OF THE INVENTION

Accordingly, it is a primary object of the present invention to overcome the disadvantages of the prior art and to provide a high-dispersion shotgun shell capable of producing large shot patterns at close-range.

Another object of the present invention is to impart a radial velocity component to a column or load of shot in a shotgun shell by capturing high pressure propellant gases in a chamber disposed within the load of shot.

Yet another object of the present invention is to control the flow of high pressure propellant gases into and out of a chamber disposed within a load of shot in a shotgun shell.

It is another object of the present invention to seal high pressure propellant gases within a chamber disposed within a load of shot in a shotgun shell when the propellant gas pressure outside the chamber drops to a predetermined level.

Some of the advantages of the present invention over the prior art are that the shotgun shell can be used in any gun without regard to barrel length, that higher propellant gas pressures than those available at the gun muzzle can be captured for use in dispersing the shot column, and that the shotgun shell can be manufactured using conventional materials and known shotgun shell components.

The present invention is generally characterized in a shotgun shell including a sabot with a tubular portion extending from a base, a chamber disposed within the tubular portion in communication with an opening in the base, a load of shot disposed within the tubular portion around the chamber, and a valve disposed between the chamber and the opening to control the flow of propellant gases into and out of the chamber. The valve can be a choke with a flow constricting orifice that delays pressurization and depressurization of the chamber. Alternatively, or in addition to a choke valve, a movable valve member can be disposed between the chamber and the opening to seal with a valve seat in order to capture high pressure propellant gases which, upon emergence of the sabot from the gun barrel, will assist in creating a highly dispersed shot pattern at close range. Also disclosed are a number of ways in which the sabot can be modified to control the stiffness of the tubular portion in order to change the shape of the shot pattern to suit specific applications.

Other objects and advantages of the present invention will become apparent from the following description of the preferred embodiments taken in conjunction with the accompanying drawings, wherein like parts in each of the several figures are identified by the same reference numerals or by reference numerals having the same last two digits.

DESCRIPTION OF THE PREFERRED EMBODIMENTS

Figure 1:
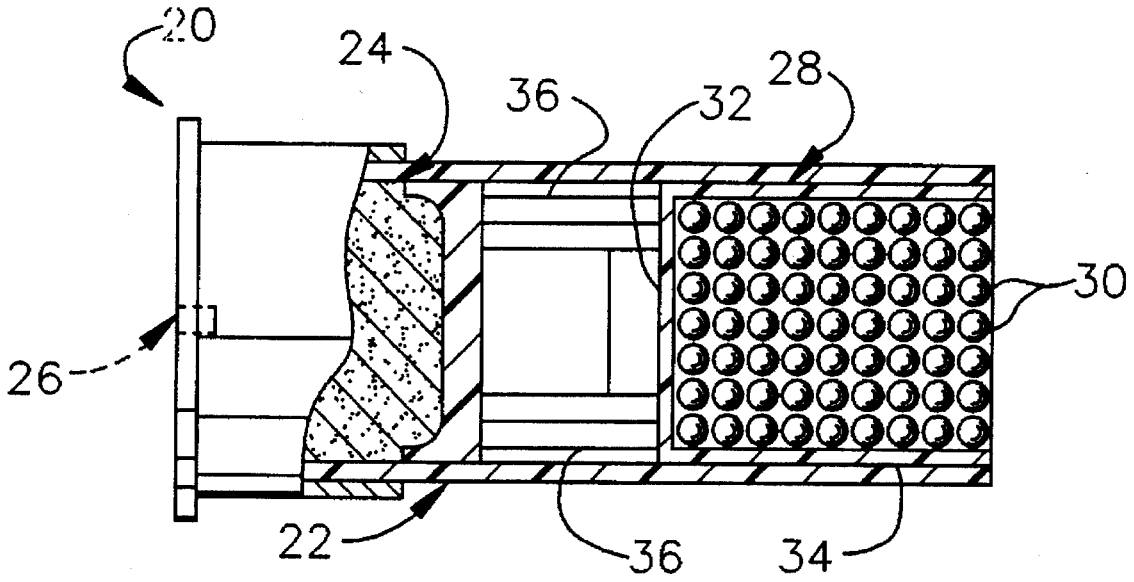
FIG. 1 (PRIOR ART)
FIG. 1 is a side view, partly in section, illustrating a prior art shotgun shell.
Figure 2:
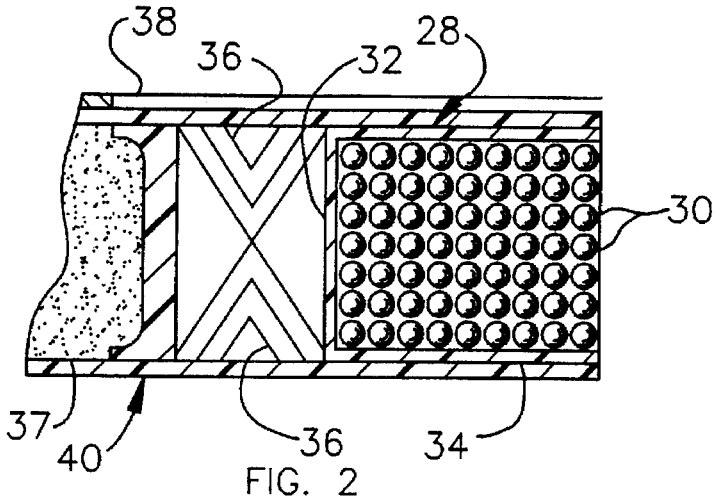
FIG. 2 (PRIOR ART)
FIGS. 2 and 3 are fragmentary side views, partly in section, illustrating operation of the prior art shotgun shell shown in FIG. 1.
Figure 3:
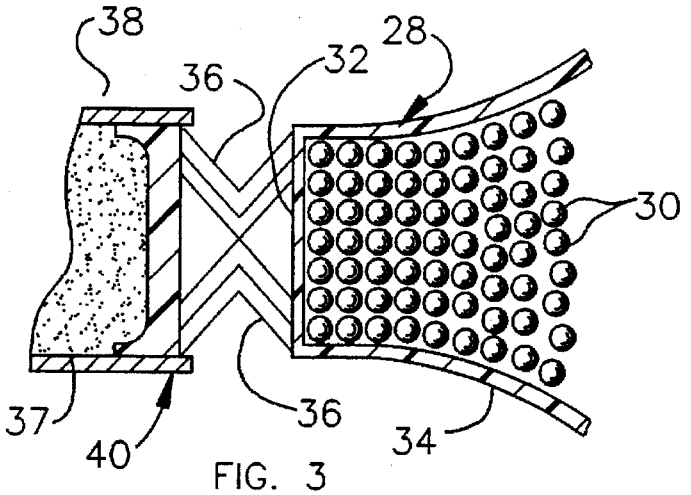
FIG. 3 (PRIOR ART)
Figure 4:
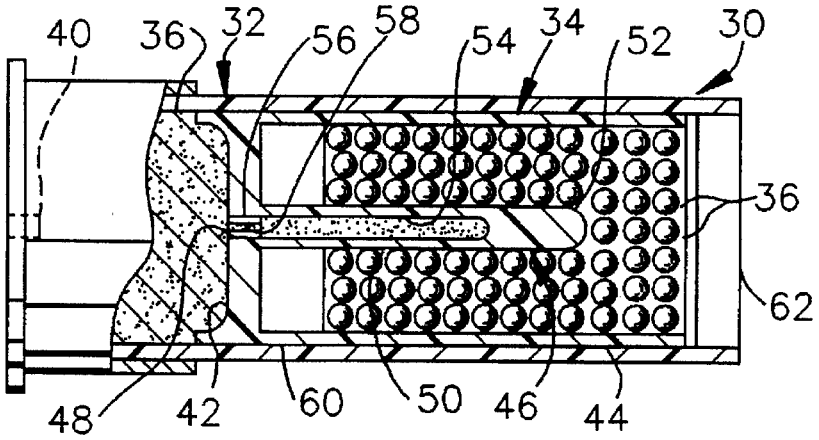
FIG. 4 is a side view, partly in section, showing a shotgun shell according to the present invention.

A shotgun shell 30 according to the present invention, as shown in FIG. 4, includes a shell casing 32, a sabot 34 telescopically received within the shell casing, a load of shot composed of a plurality of shot pellets 36 disposed within the sabot and a propellant charge 38 disposed between the sabot and a base of the shell casing adjacent a primer 40. Shell casing 32, propellant 38 and primer 40 are of conventional design and can have any configurations and can be made of any desired materials in order to be compatible with a wide variety of shotguns.

Sabot 34 includes a generally circular base 42, a tubular portion 44 of cylindrical configuration extending from a peripheral edge of the base, and an elongate chamber 46 disposed along a longitudinal axis of the tubular portion in communication with an opening 48 formed in the base. Chamber 46 includes a long, narrow cylindrical section 50 terminating in a rounded cap 52 at a forward end, the cylindrical section and cap defining an elongate longitudinal cavity 54 amid the load of shot. A choke 56 of cylindrical or ring-like configuration with a central hole, passage or orifice 58 formed therethrough is mounted within opening 48 in the base, and the passage is preferably of smaller cross-sectional diameter than the cavity to constrict the flow of gases into and out of the chamber 46.

A buffer 60 formed of conventional buffer materials is disposed within the tubular portion of the sabot between the load of shot pellets 36 and the base 42 to absorb shock and to assist in forming a uniform shot pattern. A standard crimp, shown with broken lines at 62 in FIG. 4, closes the forward end of the shell casing to prevent shot pellets from falling out of the sabot.

Figure 5:
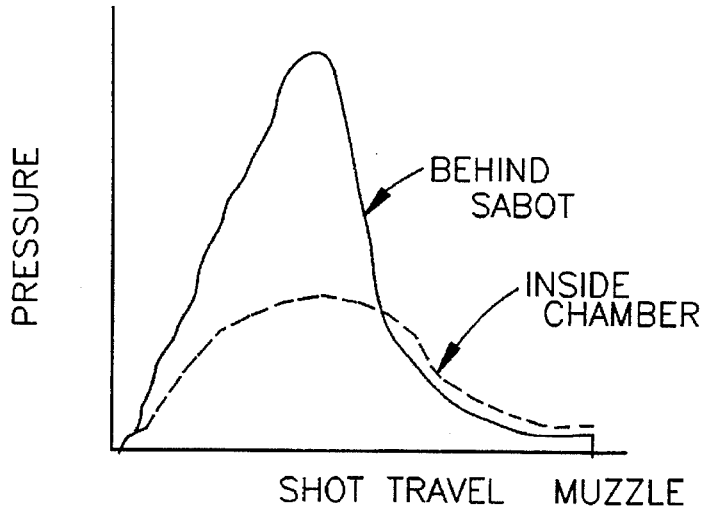
FIG. 5 is a graph of pressure versus shot travel for the propellant gases behind the sabot of the shotgun shell of FIG. 4 and for propellant gases disposed within a chamber formed by the sabot according to the present invention.

In use, the shotgun shell 30 is loaded into the chamber of a conventional shotgun and fired in the usual manner causing the primer 40 to ignite the propellant 38 which is combusted to form propellant gases at high pressure. The propellant gases expand within the shell casing 32, exerting axial pressure on the base 42 of the sabot as shown graphically in FIG. 5 with solid lines. Sabot 34 is moved forward, in an axial direction, out of the shell casing 32 and along the gun barrel under the influence of the expanding propellant gases, some of which enter the chamber 46 via the passage 58 of choke 56. As depicted graphically in FIG. 5 with broken lines, the gas pressure within the chamber 46 will reach a peak value or maximum somewhat after the gas pressure outside the cavity has peaked. The choke 56 also delays depressurization of the chamber 46 such that, when the sabot 34 reaches the lower pressure region at the end of the barrel adjacent the gun muzzle, the gas pressure within the chamber will be greater than that outside the chamber. As the sabot 34 emerges from the barrel of the gun, the sabot is no longer radially constrained by the barrel, and the relatively high pressure gases disposed within the chamber 46 will tend to expand the cavity radially outward imparting a radial velocity component to the shot pellets 36. If the spread angle of the shot is written as $\Theta = \arctan v_{radial}/v_{axial}$, with $\Theta$ representing a half angle, the radial velocity ($v_{radial}$) component will be influenced by the radial load on the shot imparted by the expanding propellant gases within the chamber as well as the release of the radial constraint. Release of the radial constraint is proportional to the muzzle velocity while the radial load on the shot is proportional to the radial acceleration of the gases and the mass of the shot. For example, in the case of a shot pellet with a weight of 0.00125 lbs and a 0.09 inch radius disposed within a sabot having a length of about 0.8 inch and a muzzle velocity of 1,275 feet per second, if the internal pressure of the propellant gases within the chamber are about 5,000 psi, the acceleration of the shot pellet would be about 3,272,000 feet per second$^2$. If the time for emergence (release of the radial constraint) is taken to be about 0.00005229 seconds, the radial velocity at the gun muzzle would be about 171 feet per second. Therefore, the half angle of emergence would be arctan (171/1,275)=7.6 degrees and, for a target located 15 feet from the gun, the shot pattern would be about 4 feet across.

Figure 6:
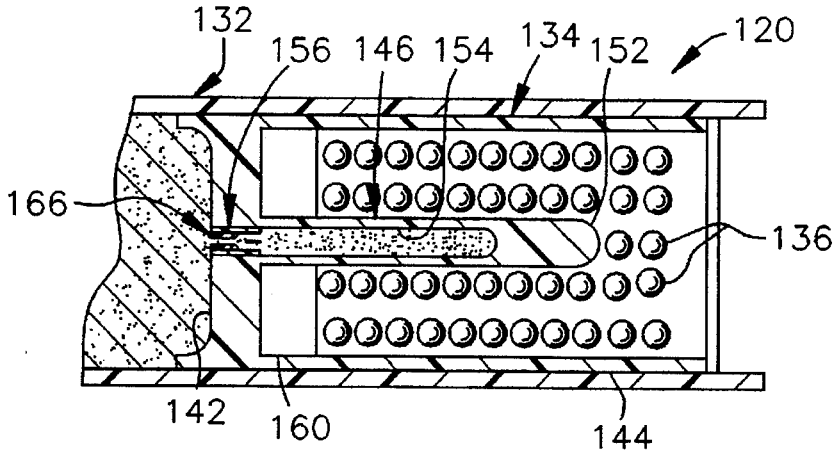
FIG. 6 is a fragmentary side view, partly in section, illustrating a modified shotgun shell according to the present invention.

The shotgun shell according to the present invention can be modified as shown in FIG. 6 at 120 to include a check valve 166 to assist in capturing high pressure propellant gases. Check valve 166 is mounted within passage 158 of the choke and includes a spherical valve member 168 movably disposed between an annular valve block 170 and a stop 172. Valve block 170 defines a gas inlet 174 therethrough and a concave valve seat 176 having a configuration to seal with the valve member when the valve member is forced rearwardly against the valve block. The components of the check valve, such as the valve block, stop and valve member, can be formed of any suitable plastic or metal material capable of withstanding the propellant gas pressures typical of a shotgun shell. Currently, the valve block, valve member and stop are formed of a rigid plastic such as nylon.

Figure 7:
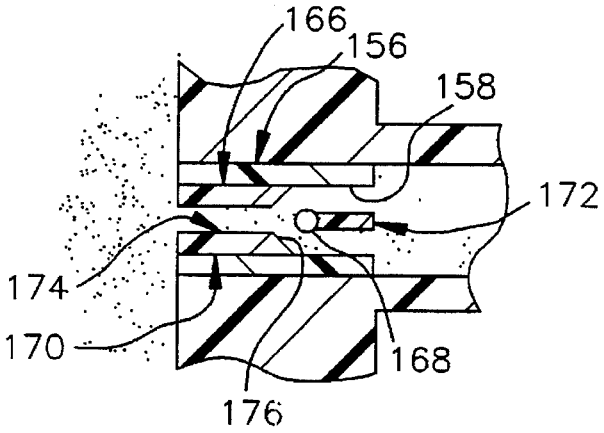
FIGS. 7 and 8 are fragmentary side views, partly in section, illustrating operation of the modified shotgun shell of FIG. 6.
Figure 8:
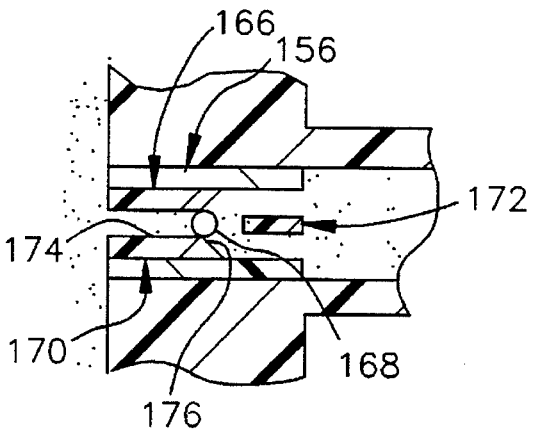
Figure 9:
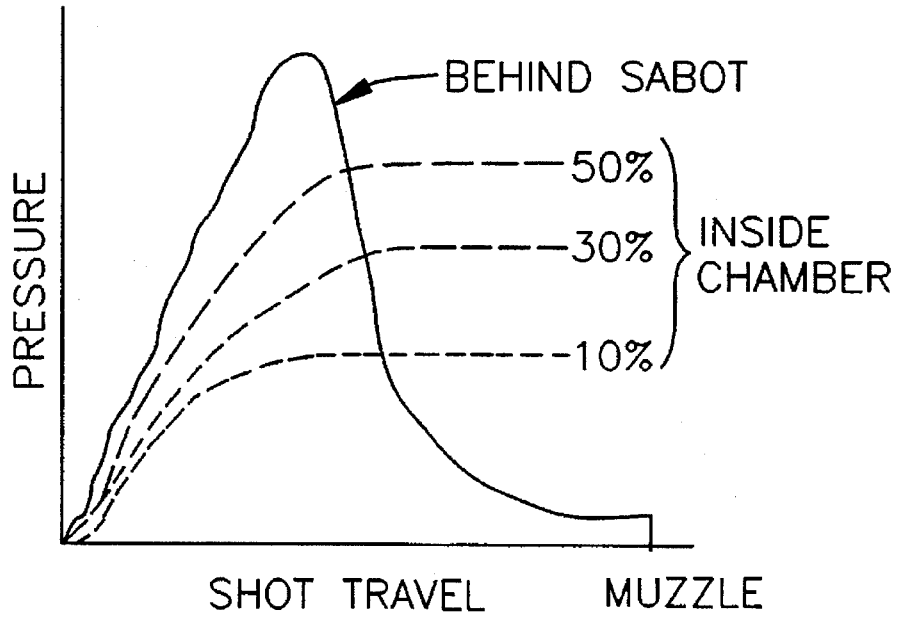
FIG. 9 is a graph of pressure versus shot travel for propellant gases behind the sabot of the shotgun shell of FIG. 6 and within the chamber formed by the sabot.

In use, when propellant gas pressure outside the chamber 146 of the sabot is greater than the internal pressure of the chamber, the high pressure propellant gases will tend to flow into the chamber, forcing valve member 168 forwardly in the space between the valve block and the stop into abutment with the stop as shown in FIG. 7. Valve member 168 and stop 172 are each somewhat smaller than passage 158 so that the propellant gases are able to flow around the valve member and the stop into the chamber 146. At some point, the gas pressure within the chamber will exceed the propellant gas pressure behind the sabot causing a net rearward force to be exerted upon valve member 168. Valve member 168 is then moved rearwardly into contact with valve block 170 as shown in FIG. 8, the valve member sealing with the valve seat 176 to prevent the high pressure propellant gases contained within the chamber from escaping. As illustrated graphically in FIG. 9, the pressure within the chamber (shown by broken lines) will stabilize when the valve closes while, at the same time, propellant gas pressure (shown by solid line) behind the sabot will continue to decrease as the gases expand. The pressure retained within the chamber will depend in part upon the size of the choke passage, the pressure increasing with larger choke passage diameters as illustrated in FIG. 9 with choke passage diameters 10, 30 and 50% of the chamber diameter. Upon emerging from the gun barrel, the radial restraint imparted upon the sabot by the barrel is removed, allowing the highly pressured gases within the chamber to assist in dispersing the shot 136.

Figure 10:
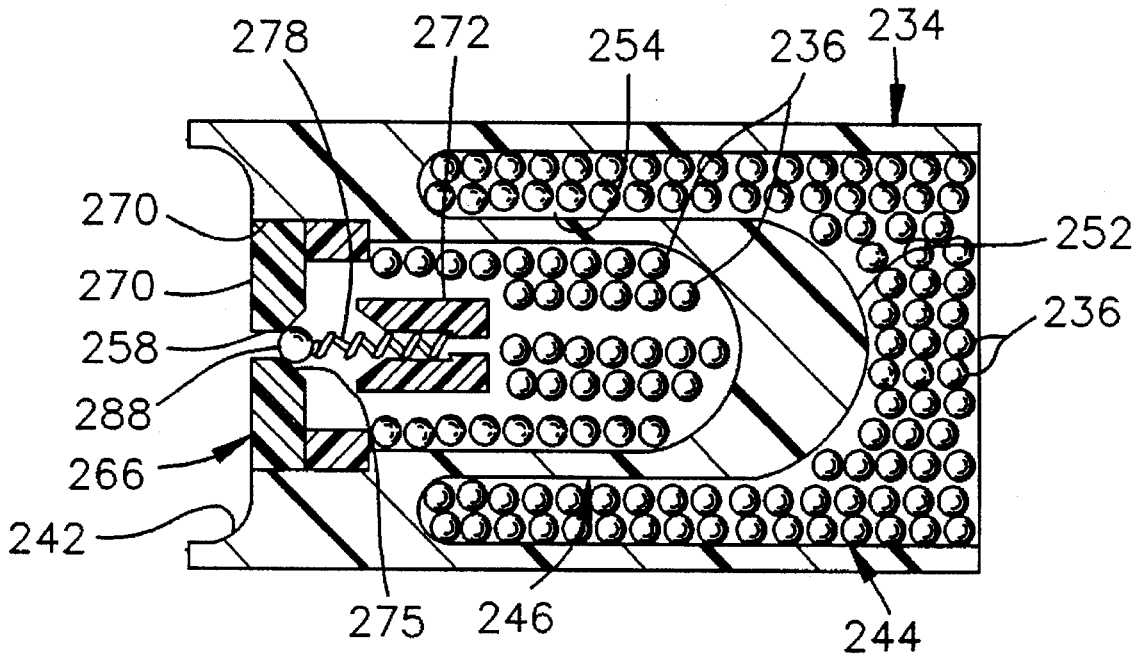
FIG. 10 is a side view, partly in section, illustrating a modified sabot for use with the shotgun shell according to the present invention.

Another modification of a sabot for use in a shotgun shell according to the present invention is shown in FIG. 10, wherein the modified sabot 234 includes a check valve 266 similar to that described above but with a bias member 278 disposed between the stop 272 and the valve block 270 to bias the valve member rearwardly to a closed position wherein the valve member is in contact with the valve seat 276 to form a seal therewith. Bias member 278 is shown as a spring held in compression between the valve member and the stop but can be any type of bias member including, but not limited to, rubber, magnets, pan springs, leaf springs, and tension springs. Chamber 254 is also shown somewhat larger in the modified sabot to accommodate shot pellets 236 therein, if desired.

A variation of the above design configuration and operating principle is enlarging the internally pressurized chamber 254 to fill the entire volume of 244. In this configuration the entire load of shot pellets will be contained in the enlarged volume of 254, and the separate chamber 244 is eliminated. In this variation the high presssure gasses and all of the shot pellets fill the chamber 254. Upon emergence from the gun barrel, the wall of chamber 254 ruptures due to the internal gas pressure, and dispenses the shot pellets by means of gas dynamic drag.

Operation of the modified sabot 234 is essentially as described above with the exception that valve 266 is biased to a closed position by bias member 278 and will not open to allow propellant gases to enter the chamber 246 until the pressure outside the chamber (i.e., in the gun barrel) is such that a force greater than the spring force is exerted on valve member 268. Similarly, the valve will not close until the propellant gas pressure in the barrel is less than the internal gas pressure within the chamber and/or the spring force exerted by bias member 278. It will be appreciated that the valve 266 can be tailored to close earlier than valve 166 (e.g., by increasing the spring force of bias member 278) such that higher pressure propellant gases can be trapped and retained within the chamber than would be possible merely through use of a choke or an unbiased valve member.

Figure 11:
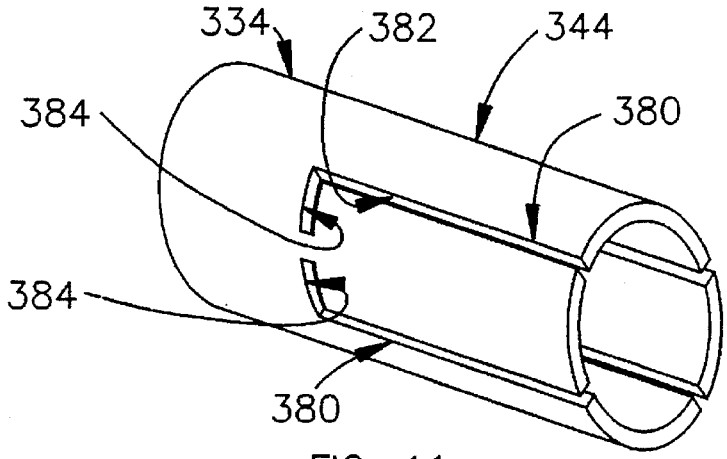
FIG. 11 is a perspective view of another modified sabot for use with the shotgun shell according to the present invention.
Figure 12:
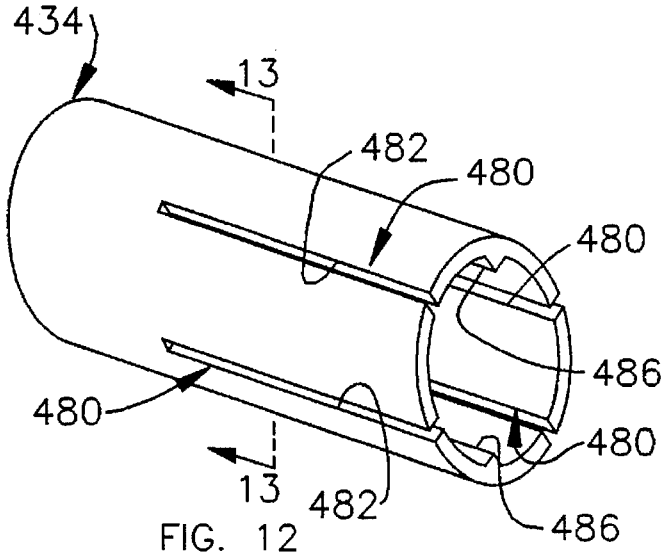
FIG. 12 is a perspective view of yet another modification of a sabot for use with a shotgun shell according to the present invention.
Figure 13:
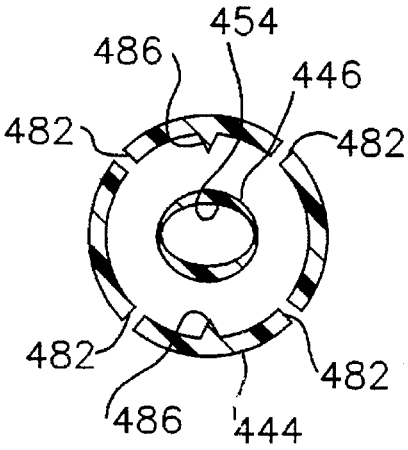
FIG. 13 is a sectional view, in elevation, of the sabot of FIG. 12 taken through line 13—13.
Figure 14:
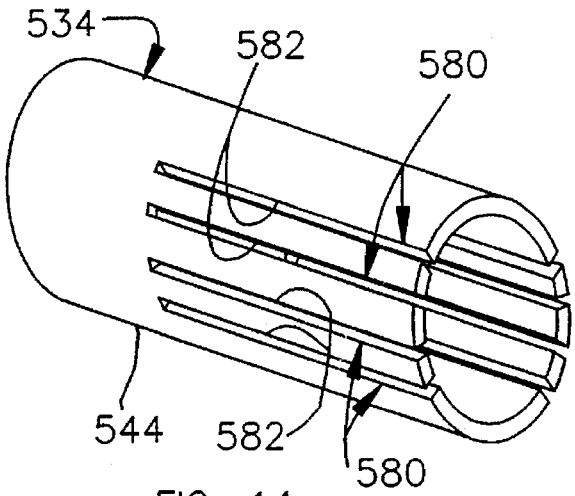
FIG. 14 is a perspective view of still another modification of a sabot for use with the shotgun shell according to the present invention.

Shot pattern can, to a certain extent, also be controlled by varying the rigidity of the tubular portion of the sabot in certain directions. For example, in FIG. 11, cuts 380 are formed at circumferentially spaced locations about the tubular portion 344 of the sabot 334 to decrease the stiffness of the tubular portion. Each cut 380 includes a longitudinal portion 382 extending in parallel with a longitudinal axis of the sabot and a circumferential portion 384 extending from the base of the longitudinal portion toward an opposed circumferential portion extending from an adjacent longitudinal portion to define a hinge therebetween of relatively low stiffness. In FIGS. 12 and 13, yet another modification of a sabot for use with a shotgun shell according to the present invention is shown wherein cuts 480 include only longitudinal portions 482 and chamber 446 is formed with non-axisymmetric walls of varying thickness such that an exterior surface of the chamber is substantially circular in cross-section while the cavity 454 therein is substantially elliptical in cross-section. Also shown in FIGS. 12 and 13 are ribs 486 formed on an interior surface of the tubular portion 444 along longitudinal axes of the sabot between cuts 480 to facilitate pivoting or rotation of the petals or fingers formed between the cuts at a single, rather than multiple, locations along the length of the sabot. Longitudinal portions 582 of the cuts 580 can also be of varying length as shown in FIG. 14, and the circumferential spacing between cuts varied to produce fewer or greater numbers of fingers as desired.

From the above, it will be appreciated that the shotgun shell and sabot of the present invention permits high pressure propellant gases to be captured and retained in order to produce a highly dispersed shot pattern at close range. The present invention also permits greater control over the size and shape of the pattern by adjusting the stiffness of the sabot so that the pattern can be tailored for specific applications.

The sabot can be formed of any suitable material including, but not limited to, low density polyethylene and other plastic and metal materials. The base of the sabot can have any shape to fit within the shell casing, and can be cupped as shown, flat or convex or have any combination of the above features. The tubular portion of the sabot can be cylindrical as shown or have any other configuration in cross-section to fit within a shell casing and hold a load of shot. The pressure chamber defined within the tubular portion of the sabot can be cylindrical as shown, conical, parallelpiped, elliptical or spherical in shape and is preferably long and narrow so that it can be disposed along the length of the shot column. The pressure chamber may also be multi-facetted to form a geometry which expands radially to increase the cross-sectional area when acted on by the internal pressure. Any number of chambers can be provided amid the shot column, and individual chambers can be communicated with each other and/or with an opening or openings in the base of the sabot. When communicated with each other and/or separate openings in the base of the sabot, valves can be interposed between the chambers and/or the chambers and the openings to regulate the flow of gas into and out of the chambers.

Flow of propellant gases into and out of the chamber can be controlled by any type of valve that regulates, restricts or obstructs flow including, but not limited to, choke valves that form flow constricting orifices and/or check valves with movable valve members sealingly engaging a valve seat.

When choke valves are used to define a flow constricting orifice or passage between an opening at the base of the sabot and a chamber disposed within the tubular portion of the sabot, the orifice can be cylindrical as shown or have sculpted walls in the form of a nozzle. Any number of orifices can be formed with the same or different configuration. Furthermore, when a choke valve is used, it can be formed separately of base and attached thereto by sonic or thermal welding, adhesives or by any type of mechanical coupling; or the choke can be integrally formed with the sabot as a one-piece unit.

When the valve includes a movable valve member sealingly engageable with a valve seat, the valve member and seat can have any configuration to seal with one another including, but not limited to, spherical, cylindrical and conical configurations and combinations of the above configurations. The valve seat can be formed with a flow constricting orifice or passage to delay pressurization and depressurization of the chamber with propellant gases or the passage can be of the same general size and shape as the chamber such that only the valve member and seat will control the flow of propellant gases into and out of the chamber.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A shotgun shell comprising a shell casing;

a sabot disposed within said shell casing and including a base with an opening formed therethrough and a tubular portion extending from a periphery of said base;

a chamber disposed within said tubular portion in communication with said opening in said base;

a load of shot disposed within said tubular portion around said chamber;

a gas producing propellant disposed within said shell casing between said sabot base and a rear portion of said shell casing, said gas producing propellant being in fluid communication with said opening in said base of said sabot; and a valve located in said sabot and disposed between said chamber and said opening to control the flow of propellant gases into and out of said chamber, wherein said valve defines a passage communicating said chamber with said propellant gases, and wherein said valve includes a valve member movable within said passage between a closed position sealing said passage and retaining propellant gases in said chamber, and an open position allowing propellant gases to flow through said passage.

2. A shotgun shell as recited in claim 1 wherein said valve includes a choke defining a passage smaller than said opening to delay pressurization of said chamber with propellant gases.

3. A shotgun shell as recited in claim 2 wherein said choke includes a ring mounted in said opening.

4. A shotgun shell as recited in claim 1 wherein said valve further includes a valve block defining a valve seat and a stop longitudinally spaced from said valve block, wherein said valve member is movably disposed between said valve seat and said stop.

5. A shotgun shell as recited in claim 4 and further comprising a bias member engaging said valve member to bias said valve member into sealing engagement with said valve seat.

6. A shotgun shell as recited in claim 5 wherein said passage is smaller than said opening to delay pressurization of said chamber with propellant gases.

7. A shotgun shell as recited in claim 1 wherein said chamber is coaxial with said tubular portion of said sabot.

8. A shotgun shell as recited in claim 7 wherein said chamber includes an elongate cylindrical portion extending into said load of shot.

9. A shotgun shell as recited in claim 1 and further comprising another load of shot disposed within said chamber.

10. A shotgun shell as recited in claim 1 wherein said chamber defines a cavity therein having a substantially elliptical cross-section and wherein an outer surface of said chamber is of substantially cylindrical configuration.

11. A shotgun shell as recited in claim 1 wherein said tubular portion is formed with circumferentially spaced longitudinal cuts to selectively reduce stiffness in predetermined directions.

12. A shotgun shell as recited in claim 11 wherein said tubular portion of said sabot is formed with pairs of circumferential cuts extending toward one another from adjacent longitudinal cuts.

13. A shotgun shell as recited in claim 1 and further comprising a plurality of ribs formed on an inner surface of said tubular portion along a longitudinal axis thereof to selectively stiffen said tubular portion in predetermined directions.

* * * * *